US009488189B2

(12) United States Patent
Alisch et al.

(10) Patent No.: US 9,488,189 B2
(45) Date of Patent: Nov. 8, 2016

(54) RADIAL COMPRESSOR AND METHOD FOR PRODUCING A RADIAL COMPRESSOR

(75) Inventors: Matthias Alisch, Potsdam (DE); Jens Böker, Berlin (DE); Reiner Landskron, Berlin (DE)

(73) Assignee: MAN Diesel & Turbo SE, Augsburg (DE)

( * ) Notice: Subject to any disclaimer, the term of this patent is extended or adjusted under 35 U.S.C. 154(b) by 1051 days.

(21) Appl. No.: 13/387,879

(22) PCT Filed: Jul. 21, 2010

(86) PCT No.: PCT/DE2010/050049

§ 371 (c)(1),
(2), (4) Date: Mar. 1, 2012

(87) PCT Pub. No.: WO2011/012127

PCT Pub. Date: Feb. 3, 2011

(65) Prior Publication Data

US 2012/0156023 A1 Jun. 21, 2012

(30) Foreign Application Priority Data

Jul. 31, 2009 (DE) ..... 10 2009 035 575

(51) Int. Cl.
*F04D 29/44* (2006.01)
*F04D 29/62* (2006.01)
(Continued)

(52) U.S. Cl.
CPC ..... *F04D 29/4213* (2013.01); *F04D 17/10* (2013.01); *F04D 29/023* (2013.01); *F05D 2230/26* (2013.01); *F05D 2230/54* (2013.01); *Y10T 29/49243* (2015.01)

(58) Field of Classification Search
CPC ..... F04D 29/4213; F04D 29/023; F05B 2230/10; F05B 2230/101; F05B 2230/102; F05B 2230/103; F05B 2230/25; F05B 2230/26
USPC ..... 415/198.1, 199.1–199.3, 183–187, 196, 415/208.1–208.3, 209.1, 211.1, 203–206; 29/557, 525.14, 888.02, 888.024
See application file for complete search history.

(56) References Cited

U.S. PATENT DOCUMENTS 3,103,892 A * 9/1963 McFarland ..... 415/185
3,733,145 A * 5/1973 Kaplansky et al. ..... 415/199.1
(Continued)

FOREIGN PATENT DOCUMENTS

DE 27 11 607 7/1978
DE 89 12 547 2/1990
(Continued)

OTHER PUBLICATIONS

International Search Report and Written Opinion for PCT/DE2010/050049, mailed Feb. 12, 2010.*
(Continued)

*Primary Examiner* — Christopher Verdier
(74) *Attorney, Agent, or Firm* — Cozen O'Connor

(57) ABSTRACT

Radial compressor and method for the production of a radial compressor, wherein the radial compressor (1) has a compressor housing (10), a compressor shaft (20) which is rotatably supported in the compressor housing, at least one compressor impeller (14) which is arranged on the compressor shaft in the compressor housing, and an inlet insert (12) which is associated with a first impeller stage of the radial compressor in a fluid path in the compressor housing and which has a determined extension in a radial direction (RR) and in an axial direction (AR) of the radial compressor. The inlet insert defines a fluid inlet passage (13) which is arranged in the fluid path upstream of a first compressor impeller and leads to the latter, and the inlet insert is formed of material having a defined material structure, wherein the fluid inlet passage is formed as a subsequently introduced spatial interruption in a material cohesion of the material structure.

8 Claims, 3 Drawing Sheets

(51) Int. Cl.

| | |
|---|---|
| ***F04D 17/10*** | (2006.01) |
| ***F04D 29/42*** | (2006.01) |
| ***F04D 29/02*** | (2006.01) |

(56) References Cited

U.S. PATENT DOCUMENTS

| | | | | |
|---|---|---|---|---|
| 4,007,996 | A * | 2/1977 | Boone | F04D 17/02 415/120 |
| 4,137,006 | A | 1/1979 | Becker | |
| 4,212,585 | A * | 7/1980 | Swarden et al. | 415/198.1 |
| 4,676,717 | A * | 6/1987 | Willyard et al. | 415/196 |
| 5,076,758 | A * | 12/1991 | Palgrave | 415/196 |
| 2004/0109760 | A1* | 6/2004 | Jones | 415/206 |
| 2004/0165984 | A1 | 8/2004 | Ochiai et al. | |
| 2009/0060727 | A1* | 3/2009 | Moss et al. | 415/196 |
| 2010/0202878 | A1* | 8/2010 | Wacker et al. | 415/208.1 |
| 2011/0158796 | A1* | 6/2011 | Albrecht et al. | 415/206 |

FOREIGN PATENT DOCUMENTS

| | | | | |
|---|---|---|---|---|
| DE | 10 2007 042 529 | A1 * | 3/2009 | F01D 9/00 |
| JP | 1-108301 | U * | 7/1989 | F01F 5/04 |
| WO | WO 2009/144102 | A1 * | 12/2009 | F04D 29/42 |

OTHER PUBLICATIONS

International Preliminary Examination Report on Patentability for PCT/DE2010/050049, mailed Jul. 2, 2012.*

* cited by examiner

RADIAL COMPRESSOR AND METHOD FOR PRODUCING A RADIAL COMPRESSOR

PRIORITY CLAIM

This is a U.S. national stage of application No. PCT/DE2010/050049, filed on Jul. 21, 2010. Priority is claimed on the following application: Country: Germany, Application No.: 10 2009 035 575.8, Filed: Jul. 31, 2009, the content of which is incorporated herein by reference.

FIELD OF THE INVENTION

The present invention is directed to a radial compressor and to a method of producing of a radial compressor.

BACKGROUND OF THE INVENTION

For purposes of guiding flow, single-stage and multistage radial compressors in which one or more compressor impellers are arranged on a compressor shaft in a compressor housing of the respective radial compressor have stator component parts which surround the compressor impellers of the respective radial compressor and which are arranged in layers or one behind the other in an axial direction of the radial compressor and together form a stator assembly of the radial compressor.

The stator component part which is associated with a first impeller stage of a radial compressor and which possibly surrounds the latter is also known as an inlet insert and can be constructed, e.g., as inlet heart.

According to the prior art, gaseous fluid, for example, is introduced into a compressor impeller rotating together with a compressor shaft in a compressor housing of the radial compressor via a fluid inlet which is formed in the compressor housing and which can have an inlet connection piece and via a fluid inlet passage which is formed in an inlet insert, and the fluid is conveyed out of the compressor impeller radially into a diffuser passage which directs the fluid into a fluid outlet passage (a spiral passage or collector passage for discharging fluid accelerated by a last compressor impeller) which is formed in a fluid discharge element. The fluid is guided via the fluid outlet passage to a fluid outlet in the compressor housing, which fluid outlet is provided, e.g., with a discharge nozzle, and is supplied to a subsequent process.

Spiral passage refers to a passage which develops or increases in cross section over the circumference of the radial compressor. In contrast, collector space refers to a passage having a constant cross section over the circumference of the radial compressor.

The inlet insert arranged in the compressor housing is commonly produced as a casting, the fluid inlet passage being produced, e.g., by casting cores. However, castings have drawbacks with regard to their lengthy delivery times and the models required for manufacture, which in many cases cannot be reused and which add substantially to production costs for the castings, and with respect to the quality thereof which may vary.

Variations in quality particularly affect dimensional stability (in this case, the dimensional stability of the fluid inlet passage in particular) and material structure which, in the case of castings, can be impaired particularly by casting defects. Casting defects can in turn lead to cracks and to machining problems or can even make it necessary to scrap the entire casting.

As a result, radial compressors which are outfitted with conventional inlet inserts of this kind are problematic for manufacturers of this type of compressor as far as maintaining the required operating characteristics such as operational reliability or fail-safety and meeting agreed-upon delivery times. Accordingly, the production of radial compressors of this kind can entail high cost risks for the producer which manifest themselves, e.g., in contract penalties, increased procurement costs and/or transportation costs, and so on. Moreover, conventional radial compressors of this type are problematic with respect to standardization and thus with respect to cost optimization of the production process.

It is thus an object of the invention to provide a radial compressor of the type mentioned above which has improved operating characteristics over conventional radial compressors and which can be produced with fewer cost risks. It is a further object of the invention to provide a method for the production of a radial compressor of this kind.

SUMMARY OF THE INVENTION

According to a first aspect of the invention, a radial compressor has a compressor housing, a compressor shaft which is rotatably supported in the compressor housing, at least one compressor impeller which is arranged on the compressor shaft in the compressor housing, and an inlet insert which is associated with a first impeller stage of the radial compressor in a fluid path in the compressor housing and which has a predetermined extension in a radial direction and in an axial direction of the radial compressor. According to the invention, the inlet insert defines a fluid inlet passage which is arranged in the fluid path upstream of a first compressor impeller of a plurality of compressor impellers and leads to this first compressor impeller, and the inlet insert is formed of material having a defined material structure, and the fluid inlet passage is formed as a subsequently introduced spatial interruption in a material cohesion of the material structure.

By defined material structure is meant, according to the present invention, that a starting material for the inlet insert is in a solid state and expressly not in a molten state, wherein the totality of all structural irregularities and structural regularities forms the material structure. In other words, the fluid inlet passage is produced, particularly in its entirety, by the separation of particles of material from, in particular, solid or massive starting material so that a number of particles and a volume of the finished inlet insert are less than that of the starting material.

A spatial interruption or cancellation of the material cohesion of such a defined material structure of the inlet insert such as is provided according to the present invention can be achieved exclusively by separating machining, e.g., dividing, chip removing (e.g., milling, drilling, turning, grinding, etc.), removal (e.g., electric discharge machining, laser cutting, electron beam cutting, thermal cutting, etc.) and so on.

However, substantially higher accuracies can be achieved, particularly also for the fluid inlet passage, by a separating method using, e.g., currently available CNC (Computer Numerically Controlled) machines such as, for example, CNC milling machines, CNC electric discharge machines, etc. Production of the fluid inlet passage by means of casting cores, which is cost-intensive, laborious and variable with respect to quality, can be dispensed with in this way.

Therefore, due to the fact that the fluid inlet passage is produced with invariably consistent quality and dimensional stability, a radial compressor having an inlet insert produced according to the present invention always has the desired, and therefore improved, operating characteristics. The cost risks in producing the radial compressor are reduced overall because of the reduction achieved, e.g., in this way in risks with respect to contract penalties relating to delivery times and/or quality and/or the higher procurement costs and/or higher transportation costs for the producer of a radial compressor of this kind.

According to an embodiment of the radial compressor according to the present invention, the material of the inlet insert is compression-formed material, and the material structure of the inlet insert is formed as a compression-formed material structure.

By compression-formed material is meant, according to the present invention, for example, forged material, cold rolled material and hot rolled material, drawn material, etc. Materials of this kind are commercially obtainable quickly and inexpensively as semifinished products. Further, compression-formed materials have an improved material structure with respect to air inclusions because, as a result of the compression forming, any possible air inclusions present after primary shaping are worked out, as it were, and therefore a more homogeneous material structure is generated.

The material of the inlet insert is preferably rolled material, particularly sheet metal or metal plate, and the material structure of the inlet insert is formed as rolled material structure. Metal sheets or metal plates in particular are commercially obtainable quickly and inexpensively in a large number of sheet thicknesses and material qualities.

According to an embodiment of the radial compressor according to the present invention, the inlet insert is formed by a plurality of inlet insert parts which are stacked one upon the other and connected to one another in axial direction of the radial compressor. The inlet insert parts are preferably welded to one another, soldered to one another or screwed to one another. In addition, suitable connections to the compressor housing and adjacent inner parts of the radial compressor can be provided.

The lamination or stacking of a plurality of inlet insert parts one on top of the other according to the invention has the advantage that the total extension of the inlet insert in axial direction of the radial compressor can be distributed among the plurality of thickness dimensions or extensions of the inlet insert parts in axial direction of the radial compressor. Therefore, the starting material to be used for the respective inlet insert parts is not subject to the limitations or minimum size requirements predetermined by the inlet insert as a whole, at least in one dimension, namely, in this case, preferably in the thickness dimension extending in axial direction of the radial compressor. This ensures a greater flexibility with respect to the basic dimensions of the starting material for the respective inlet insert parts.

The problem of limited commercially available sheet metal thicknesses, for example, can be solved in a simple manner by the stacking of a plurality of inlet insert parts one upon the other according to the present invention. In other words, when the thickness dimensioning of the inlet insert exceeds commercially available sheet metal or metal plate thicknesses, for example, a plurality of metal sheets or metal plates (inlet insert parts) are simply stacked one on top of the other and connected to one another as was described above. The geometric shape for the fluid inlet passage can be generated in every metal sheet or metal plate individually or in the metal sheets or metal plates in the stacked state.

As a result of the inventive construction of the inlet insert from a plurality of inlet insert parts, standardized inlet insert parts can be defined for certain compressor sizes so that at least the starting material for the latter, and possibly even finished inlet insert parts, can be stocked in a warehouse. In this way, radial compressors according to the invention can have a higher degree of standardization so that a cost optimization of the production process can be achieved. Further, by stocking determined inlet insert parts it is possible to respond rapidly and flexibly to customer demands.

According to an embodiment of the radial compressor according to the present invention, the fluid inlet passage is defined by at least two inlet insert parts of the plurality of inlet insert parts.

Accordingly, by stacking one on top of the other in accordance with the invention, it is possible to distribute the cross section among a plurality of inlet insert parts when a commercially available thickness dimension of the starting material for the respective inlet insert parts is not sufficient to form the entire cross section of the fluid inlet passage therein. Therefore, the person skilled in the art is substantially freed from any constraints arising from starting material when designing the fluid inlet passage and inlet insert and can accordingly realize an optimal design.

It should be noted in this connection that the fluid inlet passage can be defined by a plurality of inlet insert parts both based on its cross section and based on a possible axial path factor.

According to an embodiment of the radial compressor according to the present invention, a spiral space is formed in an inlet insert part of the plurality of inlet insert parts, and the spiral space is formed as a subsequently introduced spatial interruption in material cohesion of the material structure.

According to this embodiment of the invention, a fluid discharge element is integrated in the inlet insert in a simple, space-saving and economical manner. This additionally reduces costs and manufacturing expenditure. An embodiment of the invention of this kind is especially suitable for, but is not limited to, single-stage radial compressors.

According to a second aspect of the invention, a process for the production of a radial compressor has at least the following steps: a compressor housing is provided; a compressor shaft is provided; at least one compressor impeller is provided and is arranged on the compressor shaft; the compressor shaft is rotatably supported in the compressor housing; and an inlet insert is provided so that the inlet insert has a predetermined extension in a radial direction and in an axial direction of the radial compressor and defines a fluid inlet passage, and the inlet insert is arranged in the compressor housing so that the inlet insert is associated with a first impeller stage of the radial compressor in a fluid path in the compressor housing, and the fluid inlet passage is arranged in the fluid path upstream of a first compressor impeller of a plurality of compressor impellers and leads to this first compressor impeller, and the fluid inlet passage, particularly in its entirety, is generated in the inlet insert, particularly from the solid, by means of separating machining.

According to the present invention, separating machining can comprise, e.g., dividing and/or chip removing (e.g., milling, drilling, turning, grinding, etc.) and/or material removal (e.g., electric discharge machining, laser cutting, electron beam cutting, thermal cutting, etc.).

Substantially higher accuracies can be achieved, particularly also for the fluid inlet passage by a separating method, according to the invention, e.g., using currently available CNC (Computer Numerically Controlled) machines such as, for example, CNC milling machines, CNC electric discharge machines, etc. Production of the fluid inlet passage by means of casting cores, which is cost-intensive, laborious and variable with respect to quality, can be dispensed with in this way.

Therefore, due to the fact that the fluid inlet passage is produced with invariably consistent quality and dimensional stability, a radial compressor which is produced by the method according to the present invention and which has an inlet insert constructed according to the invention always has the desired, and therefore improved, operating characteristics. The cost risks in producing the radial compressor are reduced overall because of the reduced risks resulting in this way, for example, with respect to contract penalties relating to delivery times and/or quality and/or the higher procurement costs and/or higher transportation costs for the producer of a radial compressor of this kind.

According to an embodiment of the method according to the present invention, compression-formed material is used as starting material for the inlet insert.

As was mentioned above, compression-formed material according to the invention designates, for example, forged material, cold rolled material and hot rolled material, drawn material, etc. Materials of this kind are commercially obtainable quickly and inexpensively as semifinished products. Further, compression-formed materials have an improved material structure with respect to air inclusions because, as a result of the compression forming, any possible air inclusions present after primary shaping are worked out, as it were, and therefore a more homogeneous material structure is generated.

Rolled material, particularly sheet metal or metal plate, is preferably used as starting material for the inlet insert. In particular, sheet metals or metal plates are commercially available quickly and inexpensively in a large variety of sheet metal or metal plate thicknesses and material qualities.

According to an embodiment of the method according to the present invention, solid or massive material is used as starting material for the inlet insert.

In other words, any suitable commercially available solid material can be used as starting material because the fluid inlet passage in its entirety is worked out of the solid only subsequently by separating machining.

According to an embodiment of the method according to the present invention, a plurality of separate inlet insert parts are stacked one upon the other and connected to one another in such a way when providing the inlet insert that the inlet insert parts are arranged one after the other in axial direction of the radial compressor, wherein the inlet insert parts re preferably welded to one another, soldered to one another and/or screwed to one another.

The lamination or stacking of a plurality of inlet insert parts one on top of the other according to the invention has the advantage that the total extension of the inlet insert in axial direction of the radial compressor can be distributed among the plurality of thickness dimensions or extensions of the inlet insert parts in axial direction of the radial compressor. Therefore, the starting material to be used for the respective inlet insert parts is not subject to the limitations or minimum size requirements predetermined by the inlet insert as a whole, at least in one dimension, namely, in this case, preferably in the thickness dimension extending in axial direction of the radial compressor. This ensures a greater flexibility with respect to the basic dimensions of the starting material to be used for the respective inlet insert parts.

The problem of limited commercially available sheet metal or metal plate thicknesses, for example, can be solved in a simple manner by the stacking of a plurality of inlet insert parts one upon the other according to the invention. In other words, when the thickness dimensioning of the inlet insert exceeds commercially available sheet metal or metal plate thicknesses, for example, a plurality of metal sheets or metal plates (inlet insert parts) are simply stacked one on top of the other and connected to one another as was described above. The geometric shape for the fluid inlet passage can be generated in every metal sheet or metal plate individually or in the metal sheets or metal plates in the stacked state.

As a result of the inventive production of the inlet insert from a plurality of inlet insert parts, standardized inlet insert parts can be defined for certain compressor sizes so that at least the starting material for the latter, and possibly even finished inlet insert parts, can be stocked in a warehouse. In this way, radial compressors according to the invention can have a higher degree of standardization so that a cost optimization of the production process can be achieved. Further, by stocking determined inlet insert parts it is possible to respond rapidly and flexibly to customer demands.

According to an embodiment of the method according to the present invention, the fluid inlet passage is constructed in such a way that it is defined by at least two inlet insert parts of the plurality of inlet insert parts.

Accordingly, by stacking one on top of the other in accordance with the invention, it is possible to distribute the cross section among a plurality of inlet insert parts when a commercially available thickness dimension of the starting material for the respective inlet insert parts is not sufficient to form the entire cross section of the fluid inlet passage therein. Therefore, the person skilled in the art is substantially freed from any constraints arising from starting material in the design and production of the fluid inlet passage or inlet insert and can accordingly realize an optimal design.

It should be noted in this connection that the fluid inlet passage can be defined by a plurality of inlet insert parts both based on its cross section and based on a possible axial path factor.

According to an embodiment of the method according to the present invention, a spiral space is generated in an inlet insert part of the plurality of inlet insert parts by separating machining.

According to this embodiment of the invention, a fluid discharge element is integrated in the inlet insert in a simple, space-saving and economical manner. This additionally reduces costs and manufacturing expenditure. An embodiment of the invention of this kind is especially suitable for, but is not limited to, single-stage radial compressors.

According to an embodiment form of the method according to the invention, a chip-removing and/or material removal machining is used as separating machining.

Machining methods carried out by CNC machines such as, e.g., milling, electric discharge machining, laser cutting, electron beam cutting and thermal cutting are suited precisely for three-dimensional geometries such as the fluid inlet passage. Accordingly, the geometry of the fluid inlet passage can be reliably produced with reproducible quality and high dimensional stability.

Finally, according to an embodiment of both aspects of the present invention it is proposed that the castings for inlet inserts be replaced by structural component parts which are produced, respectively, from at least one metal sheet or metal plate or metal sheets or metal plates predominantly by chip removal. Given a suitable shaping of the flow-guiding fluid inlet passage, the latter can be produced from a metal sheet or metal plate or, when the available sheet metal or metal plate thickness is insufficient, a plurality of stacked metal sheets or metal plates by chip removal and/or by erosive methods and/or by cutting methods (laser, electron beam, thermal cutting).

When the metal sheets or metal plates are stacked, they can be screwed, soldered or welded to one another. When the metal sheets or metal plates are screwed to one another, the screw fastening can also be a component part of the screw fastening of the stator assembly in its entirety.

The invention allows not only the use of metal sheets or metal plates but also makes it possible to construct a system of standardized structural component parts.

The invention is not limited to single-stage radial compressors; rather, the invention is also applicable, for example, to multistage barrel-type or horizontally split radial compressors.

According to an embodiment form of the invention, the radial compressor is a single-shaft radial compressor.

BRIEF DESCRIPTION OF THE DRAWINGS

The present invention will be described in the following with reference to the accompanying drawings in which.

DETAILED DESCRIPTION OF THE PRESENTLY PREFERRED EMBODIMENTS

Figure 1:
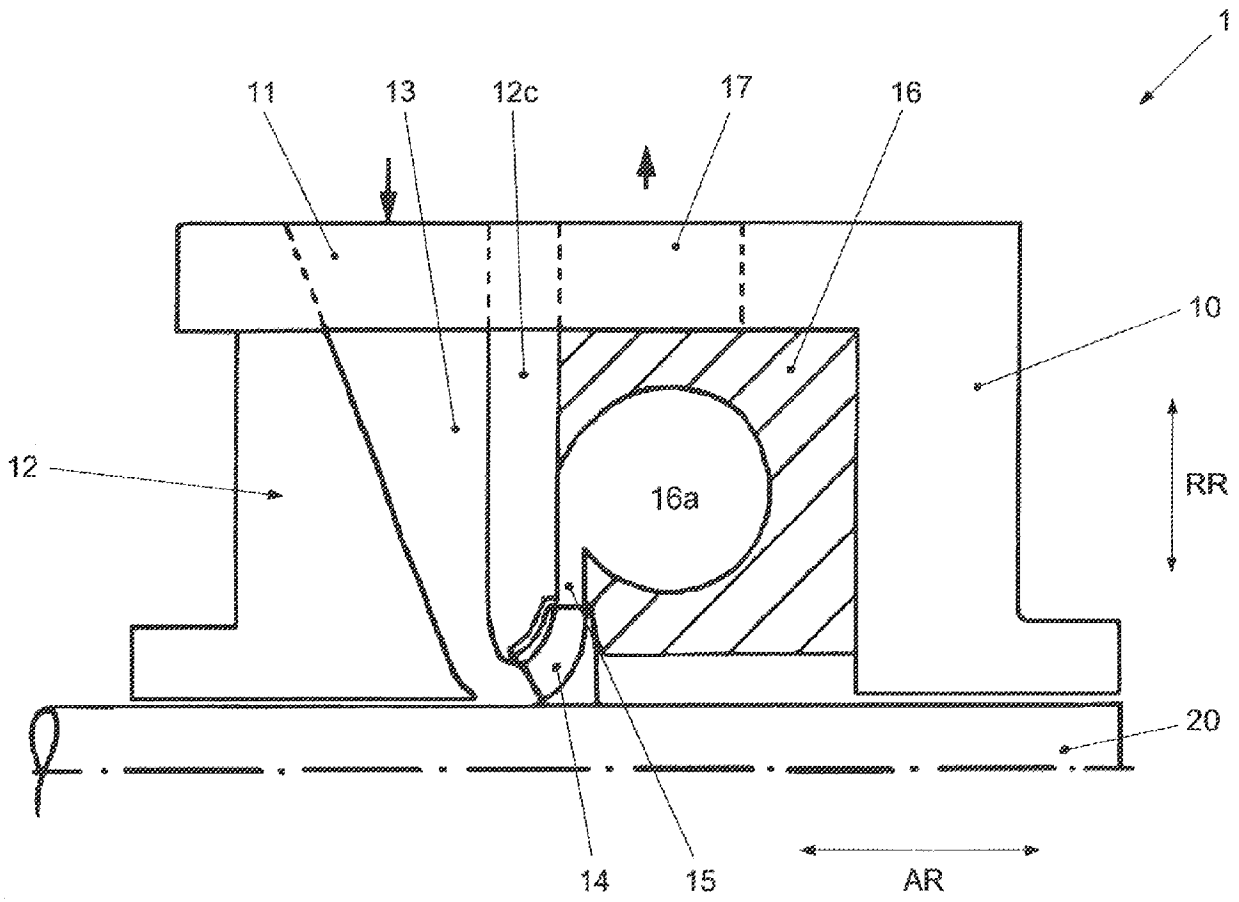
FIG. 1 is a schematic sectional view of a radial compressor according to an embodiment of the present invention.

A radial compressor 1 according to embodiments of the present invention will be described in the following with reference to FIGS. 1 to 3.

A radial compressor 1 according to the present invention has a compressor housing 10, a compressor shaft 20 which is rotatably supported in the compressor housing 10, at least one compressor impeller 14 which is arranged on the compressor shaft 20 in the compressor housing 10, and an inlet insert 12 which is associated with a first impeller stage of the radial compressor 1 in the fluid path in the compressor housing 10 and which has a predetermined extension in a radial direction RR and in an axial direction AR (see FIG. 1 and FIG. 3) of the radial compressor.

During operation of the radial compressor 1 according to the present invention, gaseous and/or liquid fluid is directed into the compressor impeller 14 rotating together with the compressor shaft 20 via a fluid inlet 11 which is formed in the compressor housing 10 and which can have an inlet connection piece (not shown) and via a fluid inlet passage 13 which is formed in the inlet insert 12, and the fluid is conveyed out of the compressor impeller 14 radially into a diffuser passage 15 which directs the fluid into a fluid outlet passage 16*a* (a spiral passage or collector passage) which is formed in a fluid discharge element 16.

The fluid is guided via the fluid outlet passage 16*a* to a fluid outlet 18 in the compressor housing 10, which fluid outlet 18 is provided, e.g., with a discharge nozzle (not shown), and is supplied to a subsequent process.

As can be seen from FIG. 1, the fluid inlet passage 13 in the inlet insert 12 is arranged in the fluid path upstream of the first (and, according to the embodiment shown in FIG. 1, only) compressor impeller 14 and leads or extends towards the latter.

Figure 2:
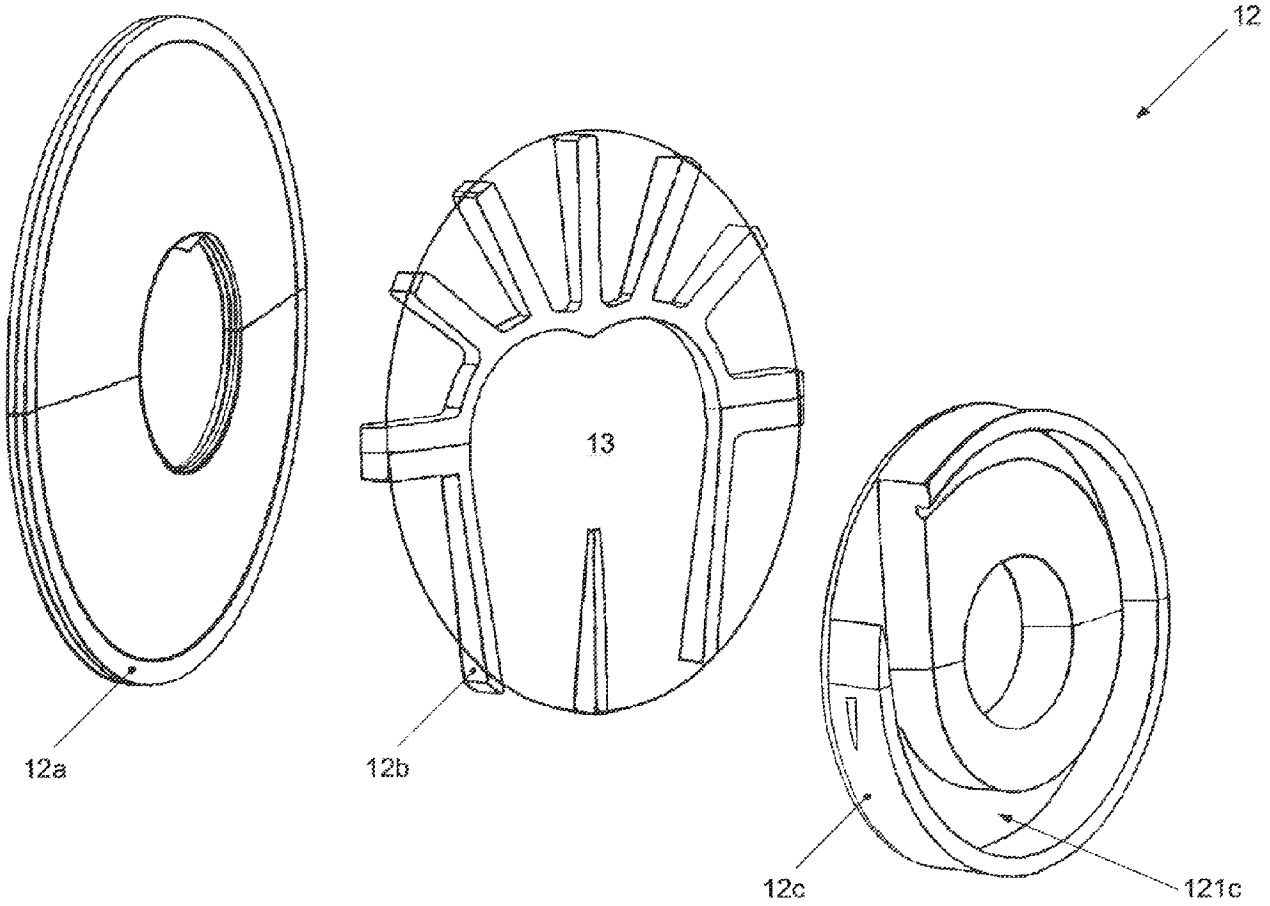
FIG. 2 is a perspective exploded view of an inlet insert of a radial compressor according to an embodiment of the present invention.
Figure 3:
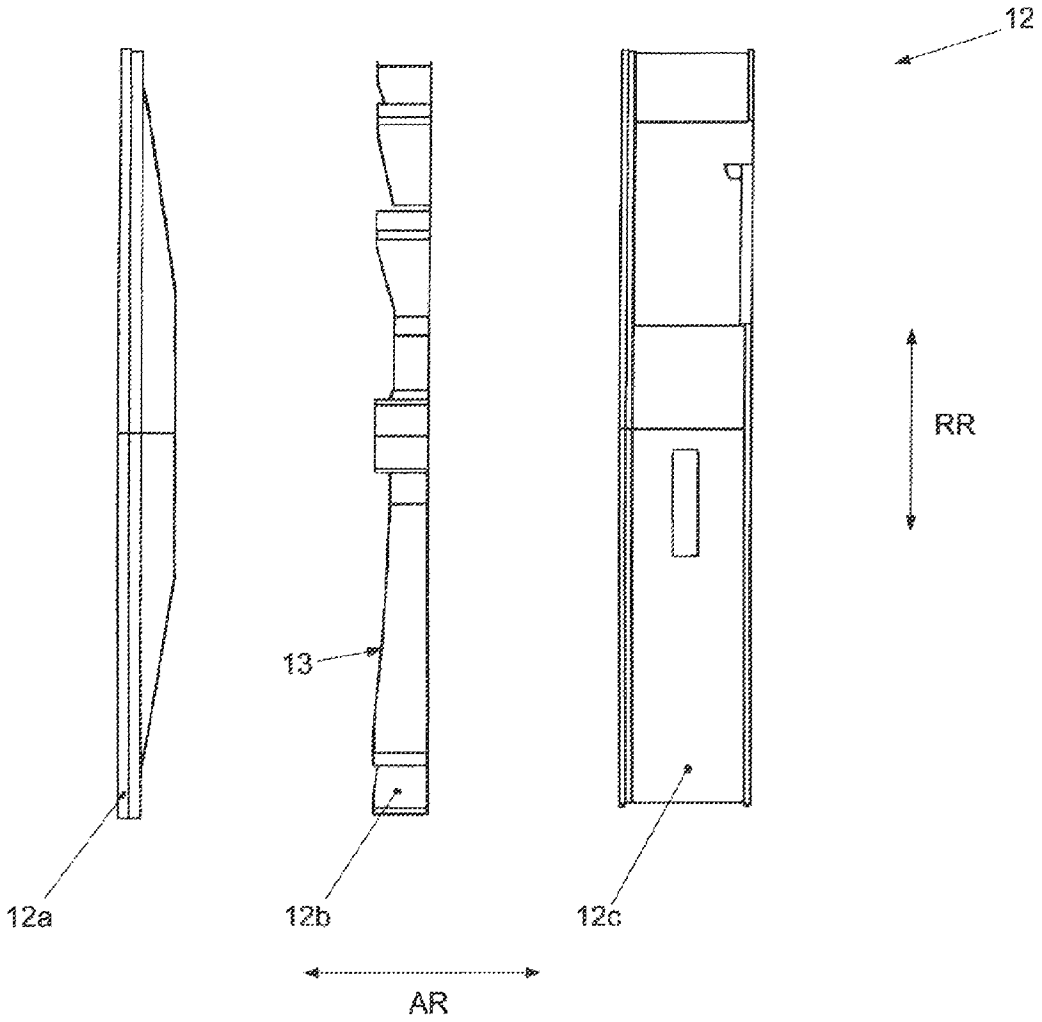
FIG. 3 is an exploded side view of the inlet insert shown in FIG. 2.

As can be seen from FIG. 2 and FIG. 3, the inlet insert 12 is formed by three inlet insert parts 12*a*, 12*b*, 12*c* which are stacked one on top of the other and connected to one another in axial direction AR of the radial compressor 1. According to an embodiment of the present invention, the inlet insert parts are welded to one another, soldered to one another and/or screwed to one another (not shown in detail).

As can likewise be seen from FIG. 2 and FIG. 3, the fluid inlet passage 13 is defined by all three of the inlet insert parts 12*a*, 12*b*, 12*c* at least by means of a wall portion thereof.

A fluid outlet passage in the form of a spiral space 121*c* is formed in the right-hand inlet insert part 12*c* in FIGS. 2 and 3. As a modification of the embodiment shown in FIG. 1, the spiral space 121*c* forms the fluid outlet passage, and the inlet insert part 12*c* forms the fluid discharge element. A configuration such as this is particularly suitable for a single-stage radial compressor. It should be noted that according to embodiments of the invention the spiral space 121*c* in the inlet insert part 12*c* can also be omitted and, instead, the fluid outlet passage can be arranged as is shown in FIG. 1.

According to an embodiment of the present invention shown in FIG. 2 and FIG. 3, the inlet insert part 12*a* shown at left in these figures is constructed as a conical disk, the inlet insert part 12*b* shown in the center in these figures is constructed as an inlet heart, and the inlet insert part 12*c* shown at right in these figures is constructed as a fluid discharge element or scroll housing element.

The inlet insert 12 is produced from a material having a defined material structure, namely, according to embodiment forms of the invention, from compression-formed material and, in the present case, in particular from rolled sheet metal or metal plate. In other words, the material structure of the inlet insert 12 and of the respective inlet insert parts 12*a*, 12*b*, 12*c* is a compression-formed material structure and, in the present case, particularly a rolled material structure.

According to the invention, the fluid inlet passage 13 and the spiral space 121*c* are generated in the solid starting material (sheet metal or metal plate) of the inlet insert 12 and inlet insert parts 12*a*, 12*b*, 12*c* by separating machining.

Accordingly, the fluid inlet passage 13 and the spiral space 121*c* are each a subsequently generated spatial interruption in a material cohesion of the material structure of the inlet insert 12.

In a simplest form, a method of producing the radial compressor 1 accordingly comprises the following steps: providing the compressor housing 10; providing the compressor shaft 20; providing at least one compressor impeller 14 and arranging the same on the compressor shaft 20; supporting the compressor shaft 20 rotatably in the compressor housing 10; providing the inlet insert 12 so that it has a predetermined extension in radial direction RR and in axial direction AR of the radial compressor 1 and defining a fluid inlet passage 13, and arranging the inlet insert 12 in the compressor housing 10 so that the inlet insert 12 is associated with a first impeller stage of the radial compressor 1 in the fluid path in the compressor housing 10, and arranging the fluid inlet passage 13 in the fluid path upstream of the first compressor impeller 14 so that it leads to this first compressor impeller 14, and generating the fluid inlet passage 13 in the inlet insert 12 by means of separating machining.

According to an embodiment of the method according to the invention, the inlet insert 12, as is shown in FIGS. 2 and 3, can be produced from a plurality of inlet insert parts 12*a*, 12*b*, 12*c* which are stacked one on top of the other in axial direction AR of the radial compressor 1, these inlet insert parts 12*a*, 12*b*, 12*c* being welded to one another, soldered to one another or screwed to one another.

The fluid inlet passage 13 can be arranged in such a way that it is defined by all three of the inlet insert parts 12*a*, 12*b*, 12*c* as is shown in FIGS. 2 and 3.

The geometric shape for the fluid inlet passage 13 can be generated in every inlet insert part 12*a*, 12*b*, 12*c* individually or in the inlet insert parts 12*a*, 12*b*, 12*c* in the stacked state. The spiral space 121*c*, if provided, can also be generated by separating machining in the inlet insert part 12*c* farthest downstream in front of or after the inlet insert parts 12*a*, 12*b*, 12*c* which are connected to one another and stacked one on top of the other.

Chip removing and/or material removal machining are/is preferably used as separating machining. Therefore, according to an embodiment of the present invention, the fluid inlet passage 13 and possibly the spiral space 121*c* can be worked out of, and generated in, the solid starting material, e.g., by milling and/or electric discharge machining.

Compression-formed material, preferably rolled material, particularly sheet metal or metal plate, can be used as starting material for the inlet insert 12 and the respective inlet insert parts 12*a*, 12*b*, 12*c*.

The invention claimed is:

1. A method of producing a radial compressor, comprising the steps of (a) providing a compressor housing (10), a compressor shaft (20), and at least one compressor impeller (14) arranged on the compressor shaft (20);

(b) supporting the compressor shaft (20) rotatably in the compressor housing (10);

(c) providing a fluid inlet insert (12) formed of plate material so that the inlet insert (12) has a predetermined extension in a radial direction (RR) and in an axial direction (AR) of the radial compressor (1) and defines a radially extending fluid inlet passage (13); wherein step (c) is performed by stacking a plurality of separate inlet insert parts (12*a*, 12*b*, 12*c*) each formed of plate material one upon the other and connecting the inlet parts to one another in such a way that the inlet insert parts (12*a*, 12*b*, 12*c*) are arranged one after the other in the axial direction (AR) of the radial compressor (1) and by using compression-formed material as starting material for the inlet insert (12);

(d) arranging each of the inlet insert parts in the compressor housing (10) so that the inlet insert parts are disposed at a suction side upstream of a first impeller stage of the radial compressor (1) in a fluid path in the compressor housing (10);

(e) arranging each of the inlet insert parts at the suction side in the fluid path upstream of said first compressor impeller (14) so as to direct fluid radially toward the first compressor impeller; and (f) generating the fluid inlet passage (13) by forming each of the inlet insert parts by means of separating machining.

2. The method according to claim 1, wherein the compression-formed material is rolled material.

3. The method according to claim 1, wherein step (c) is performed by using solid material as the starting material for the inlet insert (12).

4. The method according to claim 1, wherein the inlet insert parts (12*a*, 12*b*, 12*c*) are connected to one another by one of welding, soldering and screwing.

5. The method according to claim 1, wherein at least two inlet insert parts (12*a*, 12*b*, 12*c*) of the plurality of inlet insert parts (12*a*, 12*b*, 12*c*) are connected so as to form the fluid inlet passage (13).

6. The method according to claim 1, additionally comprising the step of generating a spiral space (121*c*) in an inlet insert part (12*c*) of the plurality of inlet insert parts (12*a*, 12*b*, 12*c*) by separating machining.

7. The method according to claim 6, wherein the step of separating machining of said spiral space is performed by one of chip-removing and material removal machining.

8. The method according to claim 1, wherein the step of separating machining is performed by one of chip-removing and material removal machining.

* * * * *